United States Patent [19]

Jochum

[11] Patent Number: 4,533,077

[45] Date of Patent: Aug. 6, 1985

[54] STOP DEVICE FOR A DRIVING PISTON IN A FASTENING MEMBER SETTING DEVICE

[75] Inventor: Peter Jochum, Meiningen, Austria

[73] Assignee: Hilti Aktiengesellschaft, Schaan Fürstentum, Liechtenstein

[21] Appl. No.: 451,922

[22] Filed: Dec. 21, 1982

[30] Foreign Application Priority Data

Dec. 28, 1981 [DE] Fed. Rep. of Germany ..... 3151661

[51] Int. Cl.[3] ..... B25C 7/00

[52] U.S. Cl. ..... 227/156; 227/149; 173/90

[58] Field of Search ..... 227/156, 149; 173/53, 173/90, 112, 92; 308/217

[56] References Cited

U.S. PATENT DOCUMENTS 2,724,116 11/1955 Termet .

3,181,626 5/1965 Sussman ..... 173/53 X 3,338,141 8/1967 Ramsay ..... 173/53

*Primary Examiner*—E. R. Kazenske

*Assistant Examiner*—Willmon Fridie, Jr.

*Attorney, Agent, or Firm*—Toren, McGeady, Stanger, Goldberg & Kiel

[57] ABSTRACT

A setting device includes a driving piston propelled by high pressure gases through a casing for driving fastening elements into a receiving material. A stop device located within the casing secures a stop element in a recess in the driving piston for holding the piston in the firing position. The stop device includes a first spring and a second spring each biasing the stop element into the recess. The first spring has a greater biasing force than the second spring. To release the driving piston from the firing position so that it can drive a fastening element into a receiving material, the propelling forces acting on the piston displace the stop element against the force of the springs and then the first spring biases the stop element against the second spring. After the stop element is displaced out of the recess only the second spring acts on the stop element so that movement of the driving piston relative to the stop element is effective without any appreciable holding action limiting such movement.

7 Claims, 4 Drawing Figures

STOP DEVICE FOR A DRIVING PISTON IN A FASTENING MEMBER SETTING DEVICE

SUMMARY OF THE INVENTION

The present invention is directed to a fastening member setting device including a driving piston propelled by high pressure gases and a spring biased stop element arranged to engage in a recess on the driving piston for holding it in a certain position.

In setting devices of the above type, to drive a fastening member, such as a nail, into a receiving material, such as concrete, the driving piston is propelled forwardly from a firing position. The propelling gas pressure is selected to assure that the driving piston is propelled forwardly at a sufficient operating speed for driving the fastening member into the receiving material.

To ensure that the driving piston is maintained in the firing position within the setting device until the device is triggered by the introduction of the propelling gases, in a known setting device a stop element has been used for holding the driving piston in the firing position. The stop element is a spring loaded ball supported in the casing of the setting device so that it is engageable within a ring groove-shaped recess in the piston shaft when the piston is in the firing position. The stop element is released when the driving piston is axially displaced through the casing by the propellent gases. As the driving piston commences its movement, the ball is displaced against the spring force.

A considerable disadvantage in this type of stop is the high susceptibility to wear of the stop element. The wear is caused by the pulsed maximum compression of the spring caused by the impact-guided ball forming the stop element. In addition, this type of stop has the further disadvantage of causing high braking forces on the driving piston when the stop element is disengaged, that is, when the driving piston is being manually returned into the firing position.

The primary object of the present invention is to provide a stop device for the driving piston of a fastening member setting device which ensures a large holding force while the driving piston is secured in the firing position and only minimum holding forces once the stop device is disengaged from the recess in the driving piston.

In accordance with the present invention, the stop device includes a first spring and a second spring each biasing the stop element into the recess and, after the stop element is displaced from its holding action, the first spring has a greater biasing force so that it displaces the stop element against the second spring.

To provide a large holding force for securing the stop element in the recess in the driving piston, the first spring is formed as a compression spring and biases the stop element substantially radially inwardly relative to the axis of the driving piston. If the stop element is guided radially outwardly from the recess as the driving piston is propelled forwardly, this outward movement is effected against the force of the first spring until the stop element is positioned in contact with the outside surface of the driving piston. In this outwardly displaced position, the first spring displaces the stop element against the biasing action of the second spring with the second spring acting substantially axially on the stop element. As a result, the force of the first spring no longer acts on the stop element during the continued forward movement of the driving piston.

Preferably, the stop device includes a stop for limiting the spring action of the first spring when the stop element is in the disengaged or released position. This stop cooperates in discontinuing the action of the first spring on the stop element. In the released position of the stop element, when the first spring directly or indirectly contacts the stop, the action of the first spring on the stop element is interrupted and only the substantially axially directed force of the second spring acts on the stop element. Accordingly, the stop element is not pressed radially inwardly against the surface of the driving piston or is pressed inwardly only with a minimum force thereby ensuring the unimpeded displaceability of the driving piston in its axial direction.

After the fastening element has been driven into the receiving material by the driving piston and the driving piston is displaced axially rearwardly within the setting device casing, the recess on the working piston returns into the region of the stop element and the stop element again engages in the recess. When the holding action of the stop element is again established, the first spring acts to prevent any radially outward displacement of the stop element from the recess. With the driving piston held in the firing position, the stop element is positively secured within the recess by the first spring and, accordingly, a reliable holding action is assured by the radially inwardly directed force caused by the first spring.

To provide a uniform distribution of force on the driving piston it is advisable if at least two and preferably four stop elements are arranged in pairs diametrically opposite one another and equiangularly distributed around the circumference of the driving piston. Further, it has proved to be desirable to utilize cylindrically shaped stop elements.

In a preferred arrangement of the present invention a pressure transmitting member is positioned between the first spring and the stop element for transmitting force therebetween. As a result, there is no direct contact between the first spring and the stop element as it moves in different directions. Such an arrangement protects the first spring and reduces wear on such spring. The stop mentioned above, forming a part of the path between the first spring and the stop element, acts in combination with the pressure transmitting member.

In another feature of the present invention the pressure transmitting member is formed as a roller body. If the stop elements are cylindrically shaped, then it is advisable to employ cylindrically shaped pressure transmitting members. The cooperation of the cylindrically shaped stop elements and pressure transmitting members ensures a reciprocal rolling of these elements and members during the engagement and disengagement of the stop elements. The advantages to be gained from such cylindrically shaped elements and members are minimum wear and limited locking forces.

Further, to protect the first spring, another feature of the present invention is the provision of an intermediate member including an annular disk part forming a face inclined obliquely to the axis of the driving piston for transmitting a resultant force from the first spring through the disk part and the pressure transmitting member to the stop element. The direction of the force provided by the first spring can be directed so that the first spring does not experience a direct impact-type load when the stop elements are disengaged from the recesses in the driving piston.

It is also preferable, primarily for protection purposes, to position a slide with an inclined contact face, similar to that on the disk part, for transmitting a resultant force from the second spring to the stop elements. The slide allows an axial deflection of the stop elements under the influence of compression of the seoond spring when the stop elements are disengaged from the recesses. Further, the engagement of the stop elements in the recesses is enhanced by the inclined contact face on the slide.

The various features of novelty which characterize the invention are pointed out with particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

DETAIL DESCRIPTION OF THE INVENTION

Figure 1:
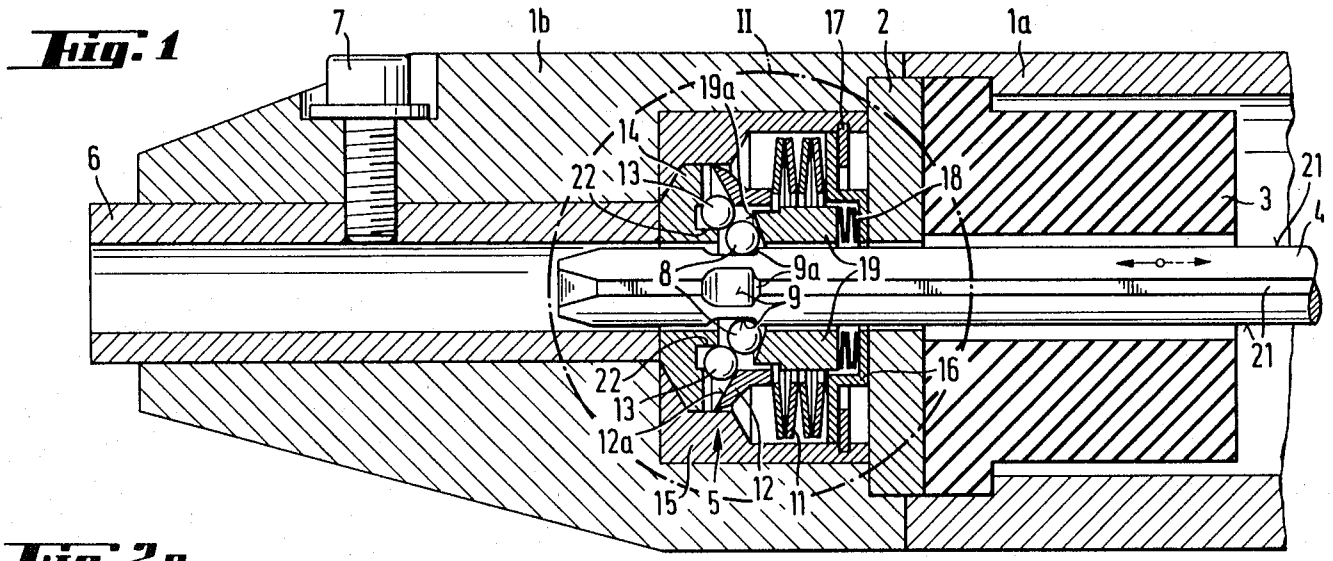
FIG. 1 is an axially extending sectional view of the front end part of a fastening element setting device with the driving piston shown in the rearward firing position.

In FIG. 1 the front end part of a fastening element seting device is illustrated with the setting device casing formed by a rear casing part 1*a* and a front casing part 1*b*. The two casing parts 1*a*, 1*b* are interconnected by a centering disk 2 so that the two parts are in axial alignment. The centering disk 2 is located partly in the front end of the rear casing part 1*a* and partly in the rear end of the front casing part 1*b*. A buffer 3 formed of an elastic material, such as hard rubber, is located in the front end of the rear casing part 1*a* with its front end surface bearing against the rearwardly facing surface of the centering disk 2. A driving piston 4, shown only in part, extends axially through the rear casing part 1*a*, through aligned bores in the buffer 3 and the centering disk 2, and its forward end projects slightly forwardly of the front end of a stop device 5 located in the rear end of the front casing part 1*b* and bearing against the forwardly directed face of the centering disk 2. The portion of the driving piston 4 extending axially forwardly of the stop device 5 is located in the trailing end of a guide or barrel section 6 secured in the front casing part 1*b* by a set screw 7. The trailing end of the barrel 6 bears against the forwardly directed face of the stop device 5.

Stop device 5 includes four cylindrically shaped stop elements 8 arranged in pairs lying diametrically opposite one another with each stop element engaged within a corresponding recess 9 in the outside surface of the driving piston. As viewed in FIG. 1, with the stop elements 8 within the recesses 9, the driving piston 4 is held in the rearward firing position of the setting device, that is, in the position with the driving piston ready to be propelled forwardly for driving a fastening element from the element device into a receiving material. The fastening elements are not shown, since they are well known to persons skilled in the art. Each of the recesses 9 has a shoulder 9*a* at its rearward end against which the corresponding stop element rests until there is ignition or development of sufficient gas pressure for initiating the forward movement of the driving piston 4 through the casing of the setting device. The stop elements 8 are pressed radially inwardly into the recesses 9 by a first spring 11 made up of Belleville springs located within the stop device 5. The biasing action of the first spring 11 is in the axial direction of the driving piston 4. The first spring 11 bears against an intermediate member 12 having an axially extending part and a disk part extending transversely of the axially extending part. The forward face of the disk part, disposed transversely of the axial direction of the driving piston, extends obliquely relative to the axis so that it has an inclined contact face 12*a* bearing against the pressure transmitting members 13 each formed as a cylindrical roller body. While the rearward surface of each pressure transmitting member 13 is in contact with the forward face 12*a* of the intermediate member 12 the forward surface of these members bears against the rearwardly facing shaped face of a supporting plate 14. The stop device 5 includes a cage or sleeve-like retainer 15 laterally enclosing the supporting plate 14. In addition, the retainer 15 laterally encircles the other parts making up the stop device 5 that is the intermediate member 12 and the first spring 11. While the forward end of the first spring 11 bears against the rearward end of the intermediate member 12 its rearward end is supported against a cup-shaped disk member 16. The radially outer part of the cup-shaped disk member 16 is supported, on the opposite side from the first spring 11, by an annular support ring 17 secured in the inside surface of a rearward portion of the retainer 15. Furthermore, a second spring 18 is located within the cup-shaped disk member 16 radially inwardly of the first spring 11 and transmits its biasing force through an axially extending slider 19 to the stop elements 8. The forwardly directed face of the slider 19 is inclined obliquely relative to the axis of the driving piston 4 in a manner similar to the face 12*a* on the intermediate member 12. Accordingly, the slider 19 transmits an inwardly directed resultant force against the stop elements 8.

Figure 3:
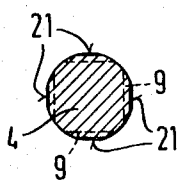
FIG. 3 is a sectional view taken along the line III—III in FIG. 2*a*.

When a gas pressure is developed in the setting device acting against the rearward end of the driving piston 4, not shown, for example, by means of the ignition of a propellent charge, the force generated by the gas pressure acting on the driving piston 4 overcomes the holding action of the stop device 5 causing the driving piston to move forwardly, that is, in the leftward direction as viewed in FIG. 1. When the force exerted by the high pressure gases acting on the drive piston 4 are sufficient to overcome the biasing action of the first and second springs 11, 18, the stop elements are guided out of the recesses 9 by the shoulders 9*a* at the rearward end of the recesses, note FIG. 2*a*. This displacement of the stop members takes place during the first phase of the forward axial displacement of the driving piston 4. As the stop elements 8 move radially outwardly, they force the pressure transmitting members 13 in the radially outward direction against the force of the first spring 11 transmitted in the axial direction through the intermediate member 12 and its inclined forward base 12*a*. As the stop elements move radially outwardly and the driving piston 4 moves axially forwardly, the stop elements move into contact with the outside surface of the driving piston. To ensure a rolling action by cylindrically shaped stop elements 8 due to their line contact with the outside surface of the driving piston 4 and to assure that such rolling movement takes place with only minimum wear, the outside surface of the driving piston is provided with axially extending flats 21 running forwardly and rearwardly of the ends of the recesses. The flats 21 each associated with one of the recesses 9, can be seen in FIG. 3 as well as in the other figures.

Figure 2B:
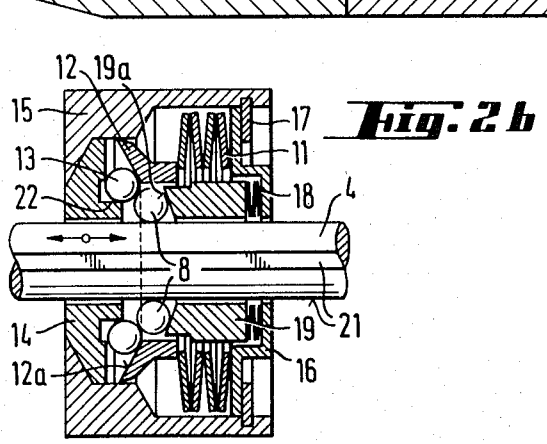
FIG. 2*b* is another showing of detail II of the setting device similar to that in FIG. 2*a*, however, illustrating the forward or rearward movement of the driving piston with the stop elements displaced out of the recesses.
Figure 2A:
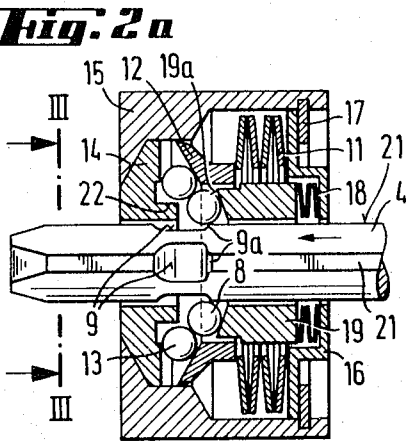
FIG. 2*a* is a showing of the detail II of the setting device shown encircled in FIG. 1, however, illustrating the driving piston at the point where the high pressure gases commence the forward movement of the piston.

As the driving piston 4 continues to move forwardly through the setting device, the first spring 11 presses the stop elements 8, now in contact with the flats 21, against the second spring 18 which has a smaller spring force than the first spring. The first spring acts through the intermediate plate and the pressure transmitting members 13 against the second spring by axially offsetting the slider 19 in the rearward direction. Following the initial radially outward displacement of the pressure transmitting members 13 by the stop elements 8, subsequently, as can be seen in FIG. 2*b*, the pressure transmitting members 13 move into contact with the stop surface 22 on the supporting plate 14 whereupon the force of the first spring 11 no longer acts on the stop elements 8.

Accordingly, during further forward movement of the driving piston 4, the stop elements bear in a practically pressure-free manner on the flats 21 on the outside surface of the driving piston. Therefore, the continued forward axial movement of the driving piston 4 takes place without any appreciable holding force by the stop device 5.

After the forward movement of the driving piston is completed and the piston is moved back into the firing position shown in FIG. 1, the recesses 9 return into the region of the stop elements 8. The second spring 18 then forces the stop elements radially inwardly into the recesses 9, into the position shown in FIG. 1, via the slider 19 and due to the influence of the rolling of the stop elements 8 on the pressure transmitting members 13. The pressure transmitting members 13 supported on the shoulder formed by the stop 22 under the biasing influence of the first spring 11 again holds the stop elements 8 in the firing position with the driving piston 8 ready to commence another operating cycle of the setting device.

While specific embodiments of the invention have been shown and described in detail to illustrate the application of the inventive principles, it will be understood that the invention may be embodied otherwise without departing from such principles.

I claim:

1. Setting device such as for driving fastening members into a receiving material, comprising a casing, an axially elongated driving piston mounted in said casing arranged to be axially displaced relative to said casing by a propelling force directed against said driving piston, said driving piston having an axially extending outside surface thereon with a recess located in said outside surface, and a stop element mounted in said casing and engageable within said recess in said driving piston for securing said driving piston in a retracted position until the propelling force is directed against said driving piston, wherein the improvement comprises means for pressing said stop element inwardly and transversely of the axis of said driving piston and securing said stop element in said recess, said means includes a first spring and a second spring each arranged for directing a biasing force against said stop element so that said stop element is directed radially inwardly into said recess with the biasing force of said first and second springs acting in the axial direction of said driving piston and being transmitted by said securing means directly to said stop element, said first spring having a greater spring force than said second spring and arranged for poviding a biasing action against said stop element so that the biasing action directs said stop element against said second spring as said driving piston experiences the propelling force and after said stop element is displaced radially outwardly out of said recess against the action of said means securing said stop element in said recess, securing means includes a pressure transmitting member located radially outwardly from and in contact with said stop element when said stop element is located within said recess and said pressure transmitting member is arranged to transmit the biasing force of said first spring to said stop element, said pressure transmitting member is formed as a roller body, said securing means comprises an intermediate member located between said first spring and said pressure transmitting member, said first spring arranged to provide a biasing force extending in the axial direction of said working piston, said intermediate member having a contact face inclined obliquely to the axis of said driving piston and disposed in contact with said pressure transmitting member for transforming the axially directed biasing force of said first spring into a radially inwardly directed force acting through said pressure transmitting member against said stop element.

2. Setting deivce such as for driving fastening members into a receiving material, comprising a casing, an axially elongated driving piston mounted in said casing arranged to be axially displaced relative to said casing by a propelling force directed against said driving piston, said driving piston having an axially extending outside surface thereon with a recess located in said outside surface, and a stop element mounted in said casing and engageable within said recess in said driving piston for securing said driving piston in a retracted position until the propelling force is directed against said driving piston, wherein the improvement comprises means for pressing said stop element inwardly and transversely of the axis of said driving piston and securing said stop element in said recess, said means includes a first spring and a second spring each arranged for directing a biasing force against said stop element so that said stop element is directed radially inwardly into said recess with the biasing force of said first and second springs acting in the axial direction of said driving piston and being transmitted by said securing means directly to said stop element, said first spring having a greater spring force than said second spring and arranged for providing a biasing action against said stop element so that the biasing action directs said stop element against said second spring as said driving piston experiences the propelling force and after said stop element is displaced radially outwardly out of said recess against the action of said means securing said stop element in said recess, said securing means includes a slider extending in the axial direction of said working piston and radially outwardly from said working piston with said slider having a pair of end surfaces extending transversely of the axis of said driving piston with one of said end surfaces disposed in contact with said second spring and the other said end surface disposed at an oblique angle to the axis of said driving piston and in contact with said stop element for biasing said stop element radially inwardly.

3. Setting device, as set forth in claim 1 or 2, wherein said stop element is a cylindrically shaped member and a multiple number of said stops elements are disposed in equiangularly spaced relation around said driving piston with a corresponding said recess for each said stop element.

4. Setting device, as set forth in claim 3, wherein four said stop elements are disposed equiangularly spaced apart around the outside surface of said driving piston with each pair of said stop elements disposed in diametrically opposed relation.

5. Setting device such as for driving fastening members into a receiving material, comprising a casing, an axially elongated driving piston mounted in said casing arranged to be axially displaced relative to said casing by a propelling force directed against said driving piston, said driving piston having an axially extending outside surface thereon with a recess located in said outside surface, and a stop element mounted in said casing and engageable within said recess in said driving piston for securing said driving piston in a retracted position until the propelling force is directed against said driving piston, wherein the improvement comprises means for pressing said stop element inwardly and transversely of the axis of said driving piston and securing said stop element in said recess, said means includes a first spring and a second spring each arranged for directing a biasing force against said stop element so that said stop element is directed radially inwardly into said recess with the biasing force of said first and second springs acting in the axial direction of said driving piston and being transmitted by said securing means directly to said stop element, said first spring having a greater spring force than said second spring and arranged for providing a biasing action against said stop element so that the biasing action directs said stop element against said second spring as said driving piston experiences the propelling force and after said stop element is displaced radially outwardly out of said recess against the action of said means securing said stop element in said recess, said stop element is a cylindrically shaped member and a multiple number of said stop elements are disposed in equiangularly spaced relation around said driving piston with a corresponding said recess for each said stop element, four said stop elements are disposed equiangularly spaced apart around the outside surface of said driving piston with each pair of said stop elements disposed in diametrically opposed relation, said driving piston having an axially extending flat formed on the outside surface thereof in axial alignment with each of said recesses so that said cylindrically shaped stop elements roll on the corresponding said flats when said stop elements are displaced out of said recesses.

6. Setting device such as for driving fastening members into a receiving material, comprising a casing, an axially elongated driving piston mounted in said casing arranged to be axially displaced relative to said casing by a propelling force directed against said driving piston, said driving piston having an axially extending outside surface thereon with a recess located in said outside surface, and a stop element mounted in said casing and engageable within said recess in said driving piston for securing said driving piston in a retracted position until the propelling force is directed against said driving piston, wherein the improvement comprises means for pressing said stop element inwardly and transversely of the axis of said driving piston and securing said stop element in said recess, said means includes a first spring and a second spring each arranged for directing a biasing force against said stop element so that said stop element is directed radially inwardly into said recess with the biasing force of said first and second springs acting in the axial direction of said driving piston and being transmitted by said securing means directly to said stop element, said first spring having a greater spring force than said second spring and arranged for providing a biasing action against said stop element so that the biasing action directs said stop element against said second spring as said driving piston experiences the propelling force and after said stop element is displaced radially outwardly out of said recess against the action of said means securing said stop element in said recess, an even multiple of said stop elements are disposed around the circumference of said driving piston with a corresponding said recess in the outside of said driving piston for each said stop element, said even multiple of said stop elements comprising at least one pair of said stop elements disposed in diametrically opposed relation, said means for securing said stop elements in said recesses comprising an axially extending retainer located radially outwardly from and extending around said driving piston, said retainer having a first end and a second end spaced from said first end each extending transversely of the axial direction of said driving piston with said first end facing in the direction in which the driving piston is propelled and said second end facing in the opposite direction, a supporting plate located within said retainer and extending from the first end thereof toward the second end, supporting means located within said retainer at the second end thereof, said first spring bearing against said supporting means and extending therefrom toward the first end of said retainer, an intermediate member located within said retainer and extending axially from said first spring toward the first end of said retainer, a corresponding pressure transmitting member within said retainer for each said stop element, said intermediate member having a surface inclined obliquely relative to the axis of said driving piston and disposed in contact with said pressure transmitting members and in spaced relation from said stop elements, said intermediate member providing a resultant inwardly directing force against said pressure transmitting member, said second spring extending in the axial direction of said setting piston and located inwardly from said first spring and radially outwardly from the outside surface of said driving piston, said second spring bearing against said supporting means at the end thereof more remote from the first end of said retainer, an axially extending slider located radially inwardly of said first spring and extending axially from the end of said second spring closer to the first end of said retainer into contact with said stop elements, and the end of said slider in contact with said stop elements having a surface inclined obliquely to the axis of said driving piston for effecting a radially inwardly directed force against said stop elements.

7. Setting device, as set forth in claim 1, 2 or 5, wherein said securing means includes a stop for limiting the path of action of said first spring when said stop element is displaced out of said recess.

* * * * *